US006409908B1

(12) United States Patent
Huber et al.

(10) Patent No.: US 6,409,908 B1
(45) Date of Patent: Jun. 25, 2002

(54) ELECTROCHEMICAL PRODUCTION OF ALKALI METAL FROM AN ALKALI METAL AMALGAM

(75) Inventors: Günther Huber, Ludwigshafen; Hermann Pütter, Neustadt; Kerstin Schierle-Arndt, Mannheim; Dieter Schläfer, Ludwigshafen; Josef Guth, Freinsheim; Bernd Schube, Mutterstadt; Diethard Lenz, Bobenheim-Roxheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/459,726

(22) Filed: Dec. 13, 1999

(30) Foreign Application Priority Data

Dec. 22, 1998 (DE) ..... 198 59 563

(51) Int. Cl.[7] ..... C25B 1/00; C25B 3/00; C25C 1/00; C25C 3/00

(52) U.S. Cl. ..... 205/338; 205/407; 205/408

(58) Field of Search ..... 205/407, 338, 205/408; 204/220, 251

(56) References Cited

FOREIGN PATENT DOCUMENTS

GB 1155927 6/1969

OTHER PUBLICATIONS

*Ullman's Enc. of Ind. Chem.*, 6th Ed., 1998, Potassium and Potassium Alloys, electronic release, No month avail.

Buchner et al., *Ind. Inorg. Chem.*, (translation), 1988, pp. 218–228, No month avail.

*Primary Examiner*—Donald R. Valentine
*Assistant Examiner*—Wesley A. Nicolas
(74) *Attorney, Agent, or Firm*—Keil & Weinkauf

(57) ABSTRACT

In a process for producing an alkali metal from alkali metal amalgam by electrolysis using an alkali metal amalgam as anode, a solid electrolyte which conducts alkali metal ions and a liquid alkali metal as cathode, the alkali metal amalgam as anode is kept in motion.

6 Claims, 6 Drawing Sheets

ELECTROCHEMICAL PRODUCTION OF ALKALI METAL FROM AN ALKALI METAL AMALGAM

Figure 1:
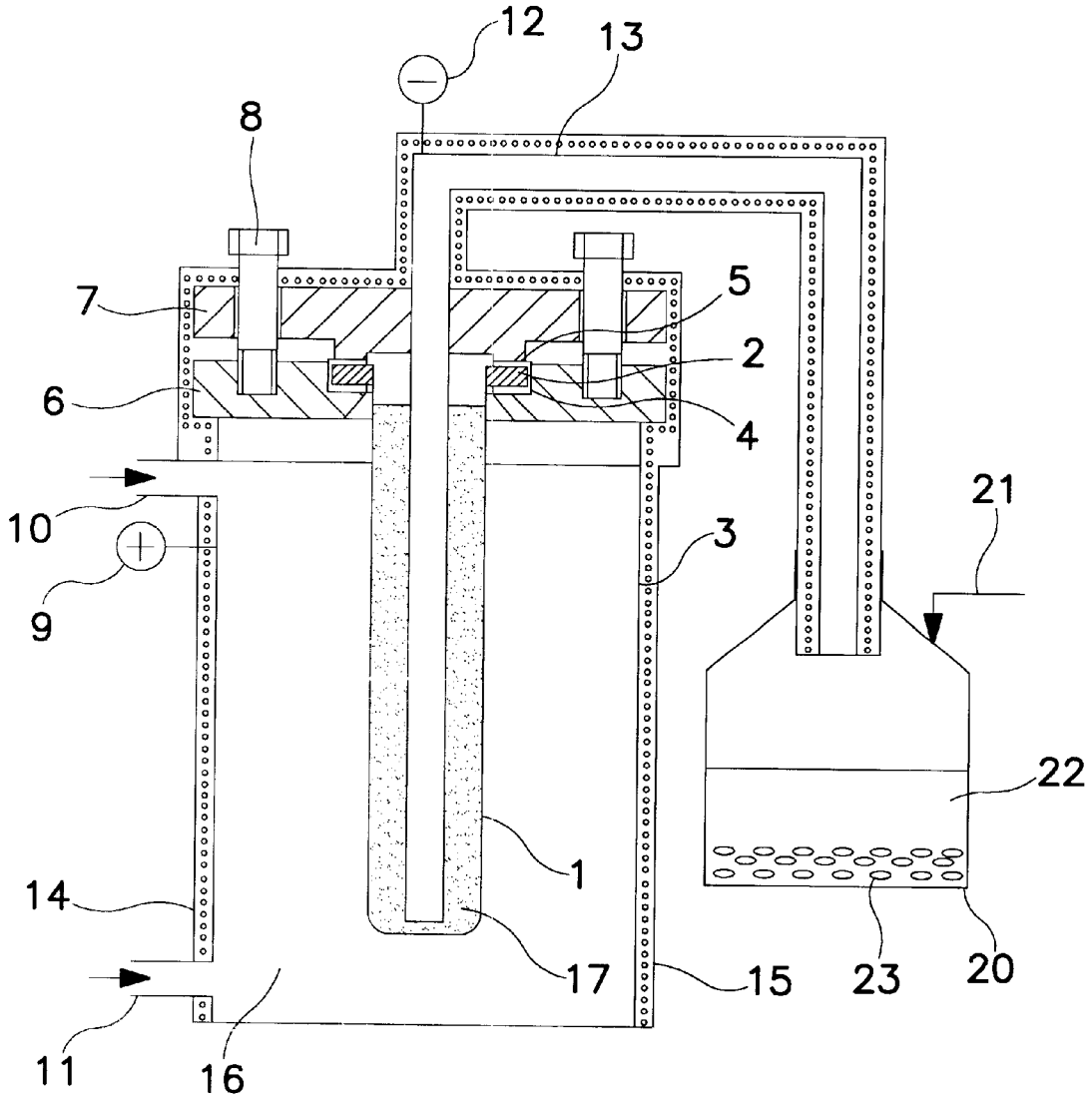
FIG. 1 PRIOR ART

The present invention relates to an improved process for the electrochemical production of alkali metal from alkali metal amalgam. For the purposes of the present invention, the term "alkali metal" refers to sodium and potassium.

The invention also relates to an electrolysis cell suitable for carrying out this process and to the principle of a production plant.

Sodium is an important basic inorganic product which is used, for example, for the preparation of sodium amide, sodium alkoxides and sodium borohydride. It is obtained industrially by the Downs process by electrolysis of molten sodium chloride. This process has a high energy consumption of ≦10 kWh/kg of sodium (Buchner et al., Industrielle Anorganische Chemie, 2nd edition, Verlag Chemie, p. 228 ff). The process also has the serious disadvantage that the electrolysis cells are destroyed by the solidification of the salt melt when they are switched off. Furthermore, the sodium metal obtained by the Downs process has the disadvantage that it is, as a result of the process, contaminated with calcium whose residual content can only be reduced, but never completely eliminated, by subsequent purification steps.

Potassium is likewise an important basic inorganic product which is used, for example, for producing potassium alkoxides, potassium amides and potassium alloys. It is nowadays obtained industrially primarily by reduction of potassium chloride with sodium. This process first produces NaK which is then fractionally distilled. A good yield is achieved by continually taking off potassium vapor from the reaction zone, thus shifting the equilibrium to the potassium side (Ullmann's Encyclopedia of Industrial Chemistry, 6th edition 1998, Electronic Release). A disadvantage is that the process operates at high temperatures (870° C.). In addition, the potassium produced contains about 1% of sodium and therefore has to be purified by a further rectification. The greatest disadvantage is that the sodium used is expensive. This is because, inter alia, sodium is obtained industrially by the Downs process by electrolysis of molten sodium chloride, which requires an energy consumption of at least 10 kWh/kg of sodium. This corresponds to about 5.3 kWh/kg of potassium (at 100% yield).

Sodium amalgam and potassium amalgam are intermediates which are formed in large quantities in chloralkali electrolysis by the amalgam process and are generally reacted with water immediately after they are produced to give an alkali metal hydroxide solution. The alkali metal amalgam which has been depleted in alkali metal or is now free of alkali metal is normally recirculated directly to the chloralkali electrolysis. In order to keep the sodium amalgam in liquid form, the sodium concentration has to be kept to values of less than 1% by weight, preferably from 0.2 to 0.5% by weight. To keep a potassium amalgam in liquid form, the potassium concentration has to be less than 1.5% by weight, preferably in the range from 0.3 to 0.6% by weight. The amalgams obtained on an industrial scale contain essentially metallic impurities in a concentration range from 1 to 30 ppm, for example copper, iron, potassium in sodium amalgam or sodium in potassium amalgam, lead and zinc.

GB 1,155,927 describes a process by means of which sodium metal can be extracted from sodium amalgam by an electrochemical route using a solid sodium ion conductor such as beta-$Al_2O_3$ with amalgam as anode and sodium as cathode. However, carrying out the process described in GB 1,155,927 does not lead to the results described there in respect of sodium conversion, product purity and current density. Furthermore, the system described displays unstable behavior over the course of a few days if the temperature range claimed is adhered to.

It is an object of the present invention to provide an improved process for the electrochemical production of alkali metal from an alkali metal amalgam, which process allows the production of sodium using less energy than the Downs process or allows the production of potassium using less energy than the industrial process discussed at the outset. For this purpose, the process described in GB 1,155,927 is to be decisively improved so that the new process can be integrated into the existing system of a chloralkali electrolysis by the amalgam method and the disadvantages found when carrying out the process of GB 1,155,927 are avoided.

The new process has to meet the following essential requirements:

The alkali metal conversion on the anode side has to satisfy the balance requirements of the product link with the chloralkali electrolysis. This means that the outflow concentration of alkali metal in the amalgam from the chloralkali electrolysis corresponds to the feed concentration in the alkali metal electrolysis of the present invention. Furthermore, the amounts of amalgam circulated between the chloralkali electrolysis and the alkali metal electrolysis of the present invention have to be kept within an order of magnitude which is technically and economically justifiable. In general, this is achieved if 50% of the alkali metal content of the feed amalgam is converted in the alkali metal electrolysis. The sodium metal has to be obtained directly in such a purity that further process steps to remove mercury can be omitted and the disadvantage of calcium contamination from which the Downs process suffers is avoided. The potassium metal has to be obtained directly in such a purity that further process steps to remove mercury can be omitted and the sodium content is less than that obtained in the reduction with sodium, where the potassium produced directly contains 1% of sodium. The process should be able to be carried out on an industrial scale and therefore has to make possible sufficiently high current densities and space-time yields. For reasons of physical structure of the production building, of safety, of environmental protection and of working capital, an equipment concept which makes do with a relatively small amount of mercury in the system is required. The process should be stable in long-term operation and tolerate without damage the usual metallic impurities occurring in industrial alkali metal amalgam. For the purposes of the present invention, "alkali metal amalgam" refers to a solution of an alkali metal in mercury that is liquid at room temperature.

We have found that this object is achieved by the process of the present invention.

The present invention accordingly provides a process for producing alkali metal from alkali metal amalgam by electrolysis using an anode containing alkali metal amalgam, a solid electrolyte conducting alkali metal ions and a liquid alkali metal as cathode, wherein the alkali metal amalgam as anode is kept in motion.

In the process of the present invention, the anode is held at such a potential that only alkali metal is anodically oxidized to alkali metal ions, the ions are transported through the solid electrolyte in the electric field and are finally reduced cathodically to form alkali metal.

In addition, the present invention provides a specifically adapted electrolysis cell comprising a tubular solid electrolyte (⅓1) which is closed at one end and is installed in a concentric stainless steel tube (33) so as to form an annular gap. The process of the present invention can be particularly advantageously operated on an industrial scale in this electrolysis cell.

Figure 2:
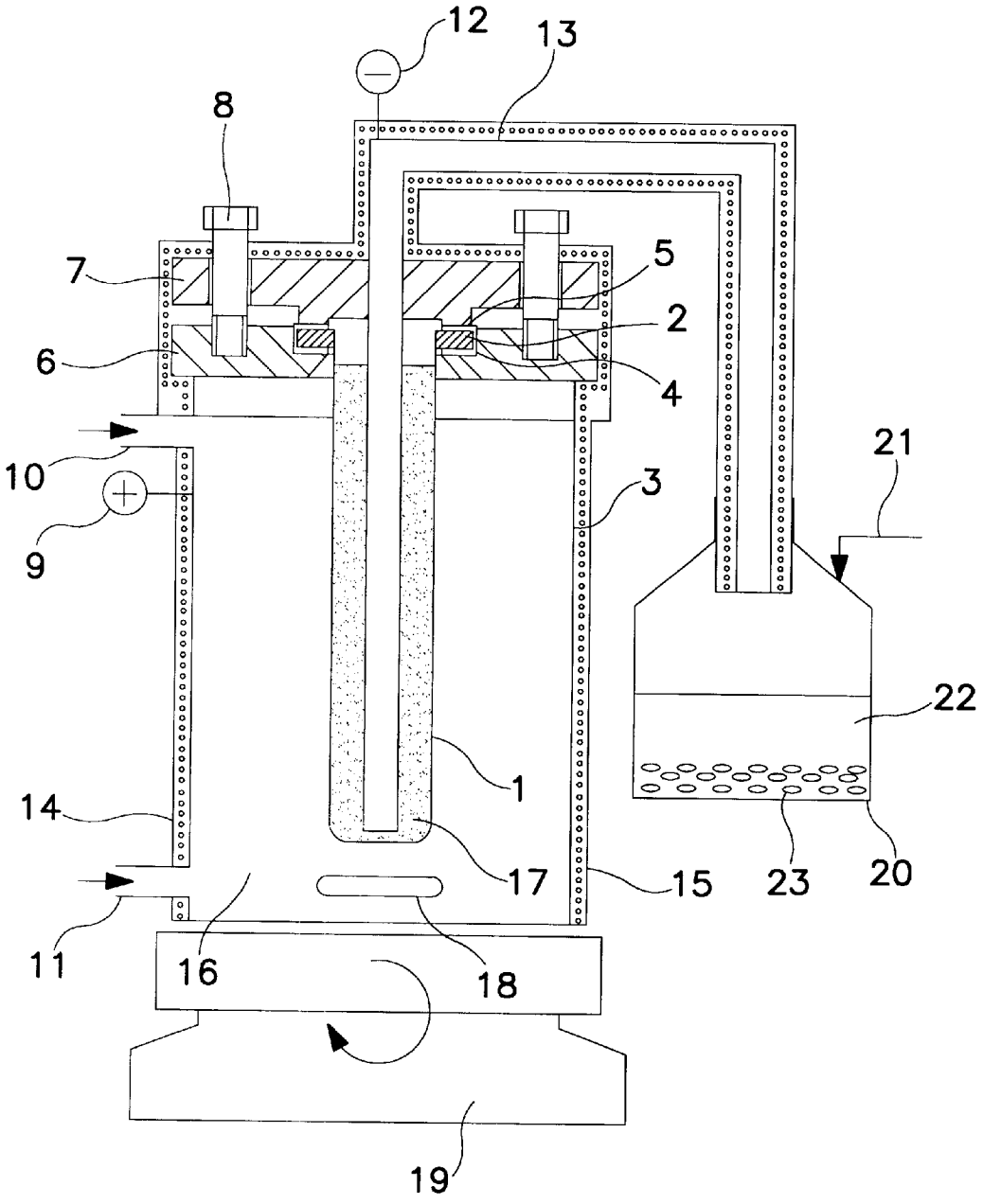
Figure 3:
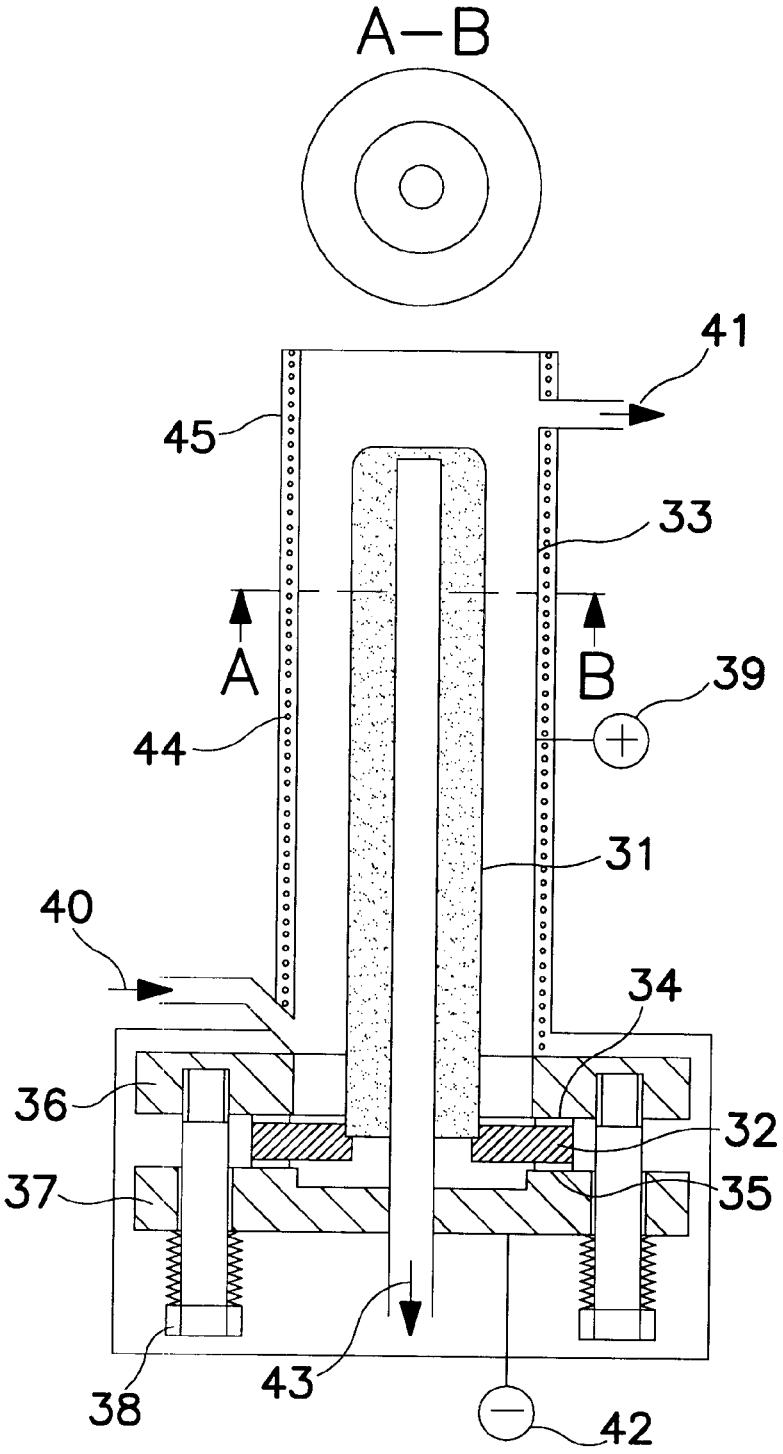
Figure 4:
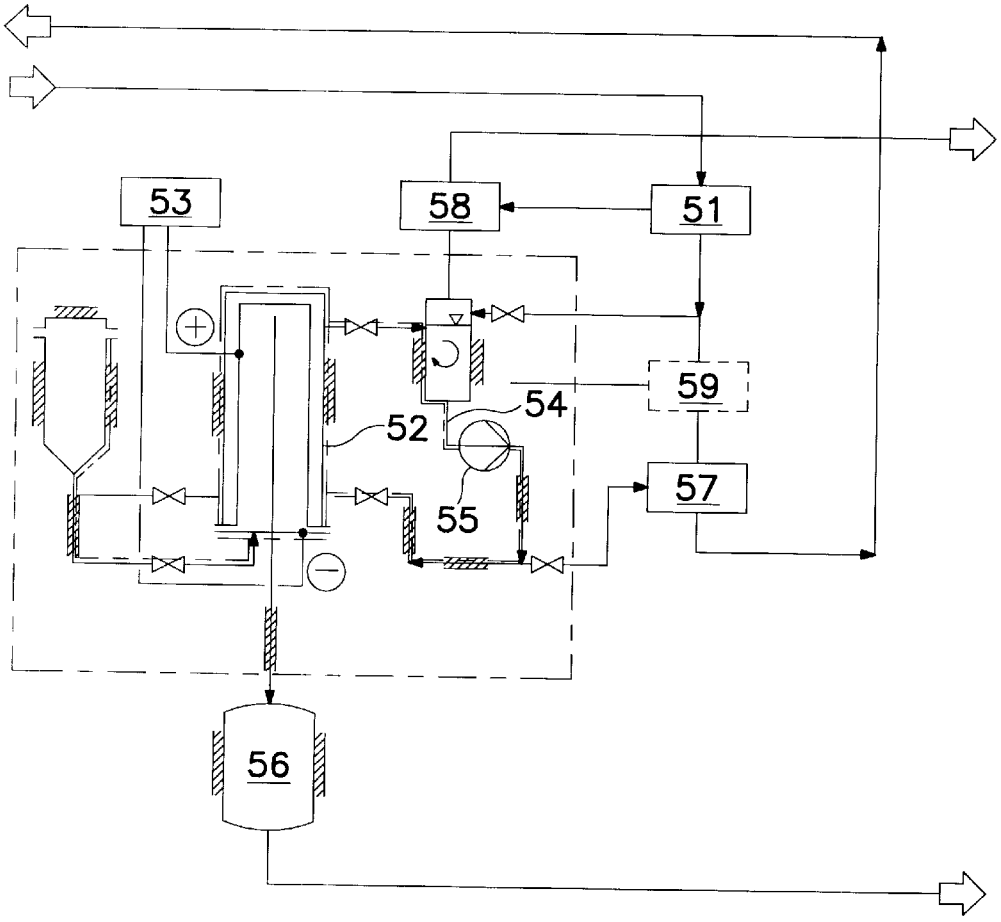
Figure 5:
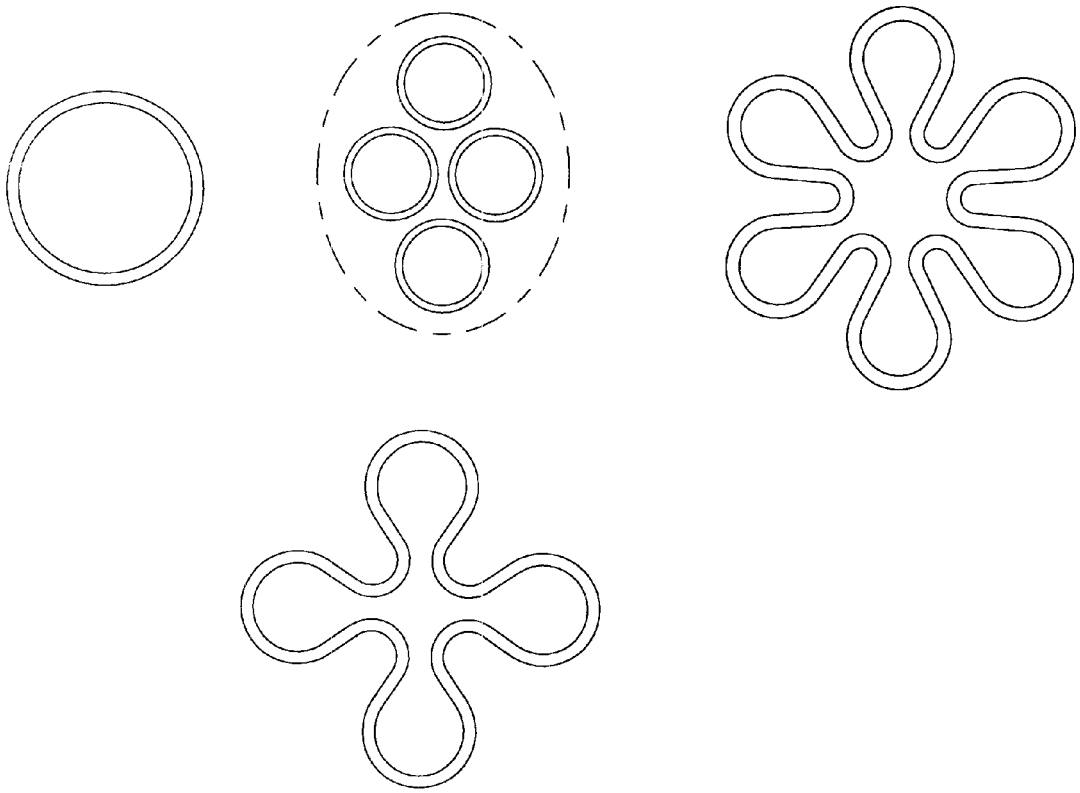
Figure 6:
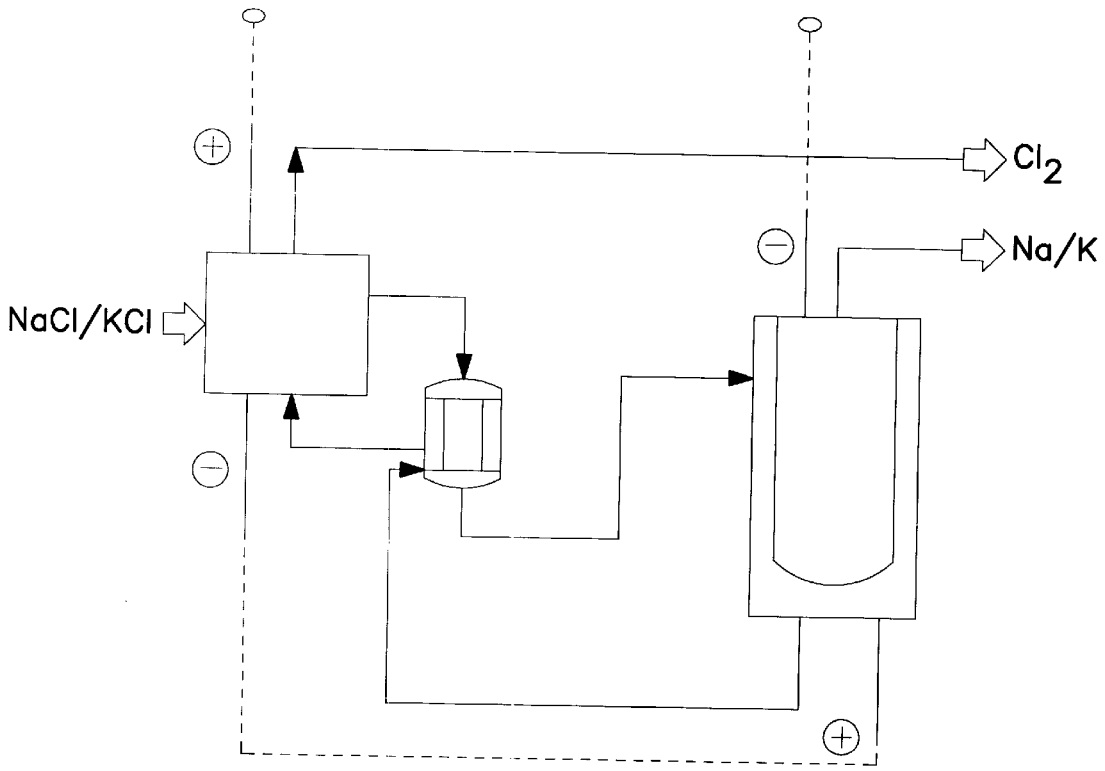

The present application is accompanied by the following figures:

FIG. 1: Schematic diagram of an electrolysis cell as described in GB 1,155,927 (comparison cell);

FIG. 2: Schematic diagram of an electrolysis cell which includes a stirrer and can be used for the purposes of the process of the present invention;

FIG. 3: Schematic diagram of an electrolysis cell according to the present invention, comprising a tubular solid electrolyte which is closed at one end and is installed in a concentric stainless steel tube;

FIG. 4: Schematic diagram of an apparatus which is designed for continuous operation and in which the electrolysis cell of the present invention is installed;

FIG. 5: Schematic diagram of the preferred cross-sectional shapes of the solid electrolyte employed according to the present invention;

FIG. 6: Schematic diagram of an integrated process for producing chlorine and alkali metal in which a chloralkali electrolysis and the electrolysis process of the present invention are coupled.

The process of the present invention is carried out in an electrolysis cell having a liquid alkali metal amalgam anode which is kept in motion. This is a liquid anode which is kept in motion and is depleted in alkali metal during operation so that it can be replaced by amalgam having a higher alkali metal content which can be obtained in a customary amalgam cell of a chloralkali production process or by electrolysis of sodium or potassium salts, e.g. NaOH or KOH, using an Hg or amalgam cathode.

This can be achieved in a technically simple fashion since the liquid alkali metal amalgam can be conveyed without problems. In general, the concentrated amalgam output of a customary amalgam cell is heated in a heat exchanger to the operating temperature of the process of the present invention and is fed to the hot, liquid anode which is kept in motion. This is advantageously carried out in a countercurrent heat exchanger so that the hot, depleted amalgam coming from the process of the present invention heats the feed.

The replacement of depleted amalgam can be carried out either discontinuously or continuously. The discontinuous procedure achieves higher alkali metal concentrations, averaged over the batch conversion. However, the continuous procedure is simpler to carry out in production. The disadvantage that the inflowing concentrate is generally diluted with circulated, depleted alkali metal amalgam can be compensated for by carrying out the process in a number of stages.

The liquid anode is advantageously kept in motion by stirring and/or by means of a pump in a circuit which is under atmospheric pressure or slightly superatmospheric pressure. The motion caused by the conversion-linked replacement of amalgam or by thermal convection is negligible in comparison to the motion required in the process of the present invention and is not sufficient to achieve the preferred current densities.

When the liquid anode described in GB 1,155,927 is operated without being kept in motion, current densities of only 40–70 $A/M^2$ can be achieved. Increasing the cell voltage enables the current density to be increased only inconsequentially because the resistance of the cell increases with increasing current density. Surprisingly, current densities of from 250 to 3000 $A/M^2$ are achieved at moderate cell voltages, i.e. cell voltages in the range from 0.9 to 1.6 volt for sodium amalgam and from 0.95 to 2.1 volt for potassium amalgam, if the anode is kept in motion. This is carried out by means of a stirring action, for example by passing bubbles of gas through the amalgam or by means of a mechanical stirrer or by means of a pump. Preference is given to motion in the form of forced flow as can be achieved, for example, using an amalgam circuit driven by a pump.

The anode-side supply of electric current is advantageously carried out via the stainless steel housing of the electrolysis cell, which is stable under the reaction conditions. The anode side is electrically insulated from the cathode side in an appropriate way.

The cathode comprises alkali metal which is in liquid form at the temperatures necessary to stabilize the anode process. When assembling the electrolysis cell, the alkali metal is advantageously introduced in the form of a solid reservoir into the cathode space. The alkali metal is then melted at the beginning of the electrolysis. However, the alkali metal can also be introduced in liquid form into the cathode space at the beginning of the electrolysis. The alkali metal formed in the process of the present invention can, in a technically simple manner, be discharged from the cathode space through an overflow with the alkali metal stream being throttled to ensure that the pressure on the alkali metal side is higher than the pressure on the amalgam side. This suppresses potential mercury contamination of the alkali metal product through micropores or other leaks. The pressure of the cathode is higher than that of the anode by from 0.1 to 5 bar, preferably from 0.5 to 1 bar, in the process of the present invention.

The supply of electric current to the cathode is advantageously carried out via the alkali metal present and the outlet pipes or connection flanges.

The anode space and the cathode space are separated from one another by a helium-impermeable solid electrolyte which conducts alkali metal ions. Suitable solid electrolytes for the production of sodium are ceramic materials such as NASICON®, whose composition is given in EP-A 0 553 400. Glasses which conduct sodium ions and also zeolites and feldspars are also suitable. For the production of potassium, there are likewise many suitable materials. Both the use of ceramics and the use of glasses are possible. Examples of suitable materials are the following: $KBiO_3$ (T. N. Nguyen et al., *Chem. Mater.* 1993, 5, 1273–1276), gallium oxide-titanium dioxide-potassium oxide systems (S. Yoshikado et al., *Solid State Ionics* 1992, 53–56, 754–762), aluminum oxide-titanium dioxide-potassium oxide systems and KASICON glasses (M. Lejeune et al., *J. Non-Cryst. Solids* 1982, 51, 273–276).

However, preference is given to sodium β"-aluminum oxide, sodium β-aluminum oxide and sodium β/β"-aluminum oxide or potassium β"-aluminum oxide, potassium β"-aluminum oxide and potassium β/β"-aluminum oxide. Potassium β"-aluminum oxide, potassium β-aluminum oxide and potassium β/β"-aluminum oxide can be prepared from sodium β"-aluminum oxide, sodium β-aluminum oxide and sodium β/β"-aluminum oxide respectively by cation exchange. The solid electrolyte advantageously has the shape of a thin-walled and nevertheless pressure-resistant tube closed at one end (EP-B 0 424 673) at the open end of which an electrically insulating ring is fitted by means of a helium-impermeable, likewise electrically insulating glass solder connection (GB 2 207 545, EP-B 0 482 785). The wall thickness of the electrolyte which conducts alkali metal ions is from 0.3 to 5 mm, preferably from 1 to 3 mm, particularly preferably from 1 to 2 mm. The cross-sectional shape of the tube closed at one end is circular in the preferred embodiment; in a further embodiment, use is made of cross-sectional shapes which have an increased surface area and can be derived, for example, from the combination of a plurality of circular areas, as is shown in FIG. 5. The configuration of the solid electrolyte which conducts alkali metal ions in respect of its freedom from leaks has a critical influence on the process of the present invention, since mercury can only get into the sodium product via leaks in the solid electrolyte or in the sealing system because the anode potentials in the process of the present invention are set so as to rule out formation of mercury ions. In general, use is made of solid electrolytes which have leakage rates of less than $1 * 10^{-9}$ mbar * 1 * $s^{-1}$ in a helium leak test, i.e. are helium-impermeable within the detection limit.

Furthermore, the releasable leak-free connections are preferably configured so that alkali metal and amalgam are each sealed from the surrounding atmosphere. If possible, releasable seals between alkali metal and amalgam are avoided because the releasable seals may well be leak-free as far as liquids are concerned but are generally not gastight. Otherwise, mercury vapor could diffuse through the releasable seal and cause undesirable contamination of the alkali metal. In a preferred embodiment, the releasable leak-free connections used are flat seals, preferably of graphite, for example of unreinforced GRAPHIFLEX®. In a preferred embodiment, an inert gas such as argon or nitrogen flows around the seals to prevent diffusion of oxygen through the seal. Electrolytes impermeable to helium and the sealing arrangement described enable residual mercury contents of from 0.05 to 0.3 ppm in the alkali metal to be obtained.

When the solid electrolyte which conducts alkali metal ions is used for the first time, one frequently observes a high ceramic resistance which remains unchanged at this high level during the course of further operation. The resistance of the solid electrolyte can be higher than the achievable values by a factor of up to 30. This is presumably attributable to the lack of reactivity of the surface. The cause may be found in the action of water in the form of the water content of the surrounding air. This damage can occur, in particular, during storage of the ceramics or during assembly. For this reason, the ceramic tubes are advantageously vacuum-packed in diffusion-proof aluminum/plastic composite foils after sintering. For storage, the ceramic tubes in their original packaging are enclosed in tightly closed, argon-filled metal containers.

The ceramic resistance can also be lowered by conditioning the ceramic:

The ceramic resistance can be significantly lowered if, for example, the cell is first operated with reverse polarity, i.e. the anode is first operated as cathode. In this case, the cathode can, like the anode in normal operation, comprise sodium amalgam and mercury. The current density is increased linearly in the reverse-polarity state from 50 $A/M^2$ to 3000 $A/m^2$ (sodium) or from 30 $A/M^2$ to 1000 $A/M^2$ (potassium) over a period of from 1 to 44 hours, preferably from 2 to 6 hours.

The lowest ceramic resistances are obtained when, during start-up, liquid alkali metal is first used as anode for from 1 to 24 hours at an operating temperature of from 300° C. to 350° C. (sodium) or from 250° C. to 350° C. (potassium) and is then replaced by amalgam. This method of carrying out conditioning is particularly preferred.

When carrying out the process of the present invention, the action of water vapor on the ceramics which conduct alkali metal ions likewise has to be prevented at all costs. This is generally achieved by heating the amalgam bearing traces of water, removing the water vapor and only then feeding the water-free amalgam/mercury mixture to the liquid anode. The removal of the water vapor is advantageously aided by stripping with inert gas or by application of subatmospheric pressure.

If the reaction temperature is maintained in the temperature range described in GB 1,155,927 , namely from 250° C. to 300° C., which represents a safety margin with respect to the boiling point of mercury, a reduction in the initially stable current density from 1000–3000 $A/M^2$ to values of 100–300 $A/M^2$ (sodium) or from 500–1000 $A/M^2$ to 50–70 $A/M^2$ (potassium) is observed over the course of from 1 to 5 days at constant cell voltage. Increasing the cell voltage leads only to an insignificant increase in the current, but results in destruction of the ceramic solid electrolyte which conducts alkali metal ions over the course of 2–5 further days. Increasing the flow velocity in the moving liquid anode of alkali metal amalgam and mercury unexpectedly leads to a further drop in the current density in this case.

Surprisingly, these limiting effects which occur after an induction time of from 1 to 5 days are not observed if the reaction temperature is maintained in a range from 310° C. to 400° C., preferably from 310° C. to 325° C., for sodium or from 260° C. to 400° C., preferably from 265° C. to 280° C., for potassium. At atmospheric pressure, the amalgam-mercury system at 400° C. is above the boiling point of mercury, namely 357° C. The undesirable emission of mercury vapor can be countered by the use of a suitable reflux condenser and operation under superatmospheric pressure.

The current density is generally above 250 $A/m^2$, preferably from 0.5 to 10 $kA/m^2$, more preferably from 1.0 to 3 $kA/m^2$, for sodium or preferably from 0.3 to 3 $kA/m^2$, more preferably from 0.5 to 1.5 kA/m , for potassium. The current density is set in a targeted manner at the external power source, generally a mains rectifier.

In a particular embodiment, the electrolysis cell of the present invention is integrated into the power supply to the amalgam-producing chlorine cell so that an additional mains rectifier becomes unnecessary (FIG. 6). The present invention therefore also provides a process as described above in which the alkali metal amalgam comes from chloralkali electrolysis.

In a preferred embodiment, the ceramic which conducts alkali metal ions is configured as a tube which is closed at one end and is introduced concentrically into the internal space of a larger outer tube. The outer tube comprises a material which is very impermeable and resistant toward hot amalgam. Particularly suitable materials are stainless steel and graphite. The liquid anode flows in a longitudinal direction through the annular gap between the outer tube and the ceramic tube. The width of the annular gap is advantageously from 1 to 10 mm, preferably from 2 to 5 mm, particularly preferably from 2.5 to 3 mm. The flow velocity is from 0.03 to 1.0 m/s, preferably from 0.05 to 0.6m/s, particularly preferably from 0.1 to 0.3 m/s. A higher flow velocity generally allows higher current densities. A further advantage resulting from the construction of the anode in the form of an annular gap is the relatively small ratio of anode volume to anode area. This makes it possible to meet the requirement of moderate apparatus weights and an acceptable mercury circulation performance.

The cell voltage is made up essentially of the following two individual contributions: the electrochemical potential of the redox system alkali metal to alkali metal amalgam and the ohmic voltage drop across the electrical resistance of the ceramic electrolyte. The cell voltage is thus a function of the current density. The electrochemical potential can be measured in the currentless state. It is established as a function of the alkali metal concentration in the liquid anode. At an alkali metal concentration of 0.4% by weight, for example, a cell voltage of 0.82 V (sodium) or 1.01 V (potassium) is established in the currentless state. At a current density of 3000 $A/M^2$, for example, a cell voltage of 1.9 V (sodium) is established. For potassium, a current density of 1000 $A/m^2$, for example, results in a cell voltage of 2.01 V.

The cell voltage is monitored and is limited so that anode potentials at which metallic impurities which are nobler in the electrochemical series could be oxidized in the moving anode are ruled out.

The value of the cell voltage can be an indicator of mass transfer from the liquid moving anode to the ceramic surface and is therefore generally monitored. Mass transfer limitation can be caused by an excessively low alkali metal concentration in the anode and/or insufficient flow and/or an excessively high current density.

Operation in the region of mass transfer limitation, i.e. at an excessively high cell voltage, can be tolerated only briefly since irreversible damage to the ceramic, e.g. loss of conductivity and mechanical embrittlement with crack formation, occurs after operation in this limiting current region for a number of days.

In a preferred operating procedure, the polarity of the current is reversed for from 1 to 10 minutes at intervals of from 1 to 24 hours by short-circuiting anode and cathode via an external resistance. The resistance is calculated so that the current on reversal of polarity corresponds to 1.5 times the current in operation. In the process of the present invention, the yield of alkali metal obtained is 100% based on the alkali metal converted at the anode. The current yield of alkali metal obtained is, within the limits of measurement accuracy, 100% in normal-polarity operation. The intermittent reversal of polarity reduces the mean current yield to 95–98%.

In a preferred embodiment, the amalgam fed to the anode is depleted from 0.4% by weight of alkali metal to 0.1% by weight of alkali metal. In the case of coupling with a chloralkali electrolysis, the unconverted alkali metal is not lost because it is returned to the chloralkali cell and from there comes back via the amalgam circuit. The present invention therefore also provides a process, as described above, for producing chlorine and alkali metal from alkali metal chloride, which comprises the following steps:

(i) carrying out a chloralkali electrolysis to give elemental chlorine and alkali metal amalgam;

(ii) carrying out a process as defined above to give alkali metal.

The present invention will now be illustrated by means of some examples, where Comparative Example 1 and Examples 1 to 3 concern the production of sodium from sodium amalgam and Comparative Example 2 and Examples 4 to 6 describe the production of potassium from potassium amalgam.

Comparative Example 1

Apparatus FIG. 1

The cell shown in FIG. 1 was similar to that described in GB 1,155,927 and comprised, in its interior, a tube (1) of sodium beta"-aluminum oxide (32 mm external diameter, 210 mm length) which was closed at one end and had a wall thickness of 1.7 mm instead of the 5 mm described in GB 1,155,927 . At the open end, a ring of alpha-aluminum oxide (2) was fitted in a helium-tight manner by means of a glass solder connection. By means of this ring, the beta"-aluminum oxide tube which conducts sodium ions was installed with the opening facing upward in a cylindrical stainless steel container (3) (having an internal diameter of about 55 mm and a length of about 250 mm and made of austenitic stainless steel 1.4571) and sealed. For this purpose, the alpha-aluminum oxide ring (2) was clamped with a flat seal below (4) and above (5) between the housing flange (6) and the cover flange (7) by means of three clamping bolts (8).

An anode power lead (9) was attached to the stainless steel container. For the introduction of amalgam, a pipe section (10) was welded on laterally at the top and a pipe section (11) was welded on laterally at the bottom to provide the outlet for the amalgam. A stainless steel tube (13) as cathodic power lead projected from the cover flange into the opening of the beta"-aluminum oxide tube. The same tube (13) is passed through the cover flange and is provided laterally at the top with a drilled hole for the outflow of liquid sodium. The apparatus was wound with electric heating tapes (14) and was thermally insulated (15).

The anode was a sodium amalgam charge (16) between the housing and the outer wall of the solid electrolyte tube which conducts sodium ions. The cathode (17) was a liquid sodium charge within the solid electrolyte tube which conducts sodium ions. The liquid sodium formed was discharged under the reaction pressure via the heated outlet pipe into an argon (21)-blanketed vessel (20) which was partly filled with paraffin oil (22) and solidified in the paraffin oil (22) in the form of small spheres (23).

Experimental Procedure

The installation of the commercial beta"-aluminum oxide tube was carried out promptly within one hour in the laboratory atmosphere after it had been taken from a vacuum pack. During installation, 60 g of sodium metal were placed in the ceramic tube. Both chambers of the cell were then flooded with argon and the cell was closed. The anode space was filled with 15 kg of 0.4% strength by weight amalgam. The filled cell was then heated to 255° C. at a heating rate of 20° C./h. In the currentless state, a cell voltage of 0.82 V was established. The output voltage of a DC grid apparatus was limited to 2 volt and the current circuit was closed with the cell. During operation of the experiment for 165 minutes, a current of from 0.8 A to 1 A was observed. A current of 1 A at the anode area of 200 $cm^2$ corresponds to a current density of 50 $A/M^2$ which is insufficient for industrial utilization of the process. During the time of the experiment, no sodium was discharged because the amount formed was not sufficient to completely fill the ceramic tube and the discharge lines. Within the limits of measurement accuracy, no decrease in the sodium concentration in the amalgam could be detected.

EXAMPLE 1

Apparatus

The experimental apparatus described in Comparative Example 1 was supplemented by a stirrer (18) (length 38 mm, diameter 8 mm) installed at the bottom of the vessel (FIG. 2). The stirrer was driven by a customary laboratory magnetic stirrer. A special device prevented the stirrer from floating in the very dense amalgam (density=13,600 $kg/m^3$).

For this purpose, the stirrer was held at the bottom of the electrolysis cell by means of a pin and a ballbearing. The stirrer speed was a maximum of 100 $min^{-1}$.

Experiment

The experimental procedure was as in Comparative Example 1, but with stirring of the anode. In addition, the polarity was initially reversed during start-up, so that the outer chamber containing the amalgam was operated as cathode and the inner chamber of the ceramic containing liquid sodium was operated as anode. Over a period of 25 minutes, the current was increased once from 5 A to 30 A in steps of 5 A each. The cell voltage followed the current steps in the following manner: 0.8 V/0.0 A; −0.2 V/5 A; 0.1 V/10 A; 0.0 V/15 A; −0.1 V/20 A; −0.2 V/25 A; −0.5 V/30 A. The experiment was then carried out as described in the Comparative Example, but with stirring of the anode. During a running time of 120 minutes, an average current of 25 A was set (initially 30 A, at the end of the reaction 20 A) . The cell voltage was limited to a maximum of 2 V. After disconnection of the power supply, a cell voltage of 0.88 V was measured in the currentless state. A current of 25 A and the anode area of 200 $cm^2$ corresponds to a current density of 1250 $A/m^2$ which allows industrial utilization of the process. During the time of the experiment, liquid sodium was discharged and dripped into an argon-blanketed glass container filled with paraffin oil. The sodium which solidified as spheres was dissolved in ethanol and analyzed for other metals (Al, Bi, Ca, Cd, Co, Cr, Cu, Fe, Li, Mg, Mn, Mo, Ni, Pb, Sb, Sn, Ti, V, Zn, Zr, Hg, K) by atomic absorption spectrometry at a detection limit of 1 ppm, with the exception of Hg 0.1 ppm. Only the following metallic impurities were found: 0.3 ppm of Hg, 50 ppm of K.

The depleted amalgam was drained from the hot (255° C.) cell into a cooled receiver. A decrease in the sodium concentration in the amalgam from 0.40% by weight to 0.14% by weight was found by titration.

EXAMPLE 2

Apparatus

The apparatus employed in the experiment corresponded to that in Example 1.

Experiment

The experiment was carried out in 6 single batches as a follow-up experiment to Example 1.

For each batch, the anode chamber which had been heated to 255° C. was refilled with 15 kg of 0.4% strength by weight amalgam preheated to about 200° C. In the currentless state, a cell voltage of 0.82 V was always established at the beginning of the reaction. The output voltage of a DC grid apparatus was always limited to 2 volt and the current circuit was closed with the cell.

The control value for the current was set to 25 A. Over a running time of 120 minutes, a constant current of 25 A at a cell voltage of from 1.0 V to 1.1 V was observed right through to the end of the reaction. This is excellent for industrial utilization of the process. An average of 42.7 g of sodium were discharged per batch. Within the limits of measurement accuracy, this corresponds to Faraday's Law. The analytical results of Example 1 were confirmed. A decrease in the sodium concentration in the amalgam from 0.40 to 0.11% by weight was found by titration.

EXAMPLE 3

Apparatus FIG. 3

The cell shown in FIG. 3 comprised, in its interior, a tube (31) of beta"-aluminum oxide which was closed at one end (32 mm external diameter, 210 mm length, wall thickness 1.7 mm). A ring of alpha-aluminum oxide (32) was fitted in a helium-tight manner at the open end by means of a glass solder connection. By means of this ring (32), the beta"-aluminum oxide tube which conducts sodium ions was installed with the opening downward in a concentric stainless steel tube (33) (having an internal diameter of 37 mm and a length of about 215 mm). The internal diameter of the steel tube was matched to the external diameter of the ceramic tube so as to form an annular gap having a width of 2.5 mm. The anode chamber defined by the annular gap and the tube length met, firstly, the need for an engineering concept which makes do with a relatively small quantity of mercury in the apparatus. Secondly, the cross section of the annulus allowed an axial flow through the anode chamber which was very effective in respect of the current density. To seal the apparatus, the alpha-aluminum oxide ring (32) was clamped with a flat seal below (36) and above (34) between the housing flange (36) and the cover flange (37) by means of three or four clamping bolts (38).

An anode power lead (39) was attached to the stainless steel container. For the introduction of amalgam, a pipe section (40) was welded on laterally at the bottom and a pipe section (41) was welded on laterally at the top to provide the outlet for the amalgam. A stainless steel tube (43) as cathodic power lead projected from the cover flange into the opening of the beta"-aluminum oxide tube. The same tube (43) was passed through the cover flange and served for the free discharge of liquid sodium. The cell could be wound with electric heating tapes (44) and insulated or installed together with a plurality of tubes in a heated chamber.

The anode was the amalgam charge in the annular space between the inner wall of the steel tube and the outer wall of the solid electrolyte tube which conducted sodium ions. The cathode was the liquid sodium charge within the solid electrolyte tube which conducted sodium ions. The liquid sodium formed was discharged under the reaction pressure via the heated outlet pipe (43) into a container which was blanketed with inert gas and partly filled with paraffin oil and solidified in the paraffin oil in the form of small spheres.

The electrolysis cell was integrated into an apparatus designed for continuous operation and having the following functions (FIG. 4).

- Continuous supply (51) with dry, preheated, Na-rich amalgam.
- Heating (52) designed for heating in the range from 310° C. to 360° C.
- DC supply (53).
- Defined flow velocity in the anode by means of an internal amalgam circuit (54) driven by a pump (55), able to be adjusted steplessly in the range from 0.02 m/s to 0.8 m/s.
- Offtake of liquid sodium (56).
- Continuous discharge of Na-depleted amalgam (57).
- Waste gas treatment (58).
- Safety monitoring, particularly in respect of Hg emission (59).

Experiment

The commercial sodium beta"-aluminum oxide tube was installed promptly within one hour in the laboratory atmosphere after it had been taken from a vacuum pack. Both chambers of the cell were then flooded with argon and the cell was closed. Installation into the apparatus was carried out 2–5 days later. The apparatus was heated to 330° C. at 20° C./h. The cathode chamber within the ceramic tube closed at one end was then filled via a feed line with externally melted sodium and the anode chamber outside the ceramic tube was likewise filled with liquid sodium. Over a period of 35 minutes, the current was increased once from 5 A to 40 A in steps of 5 A and was then held at 40 A for 4 hours. The cell voltage followed the current steps in the following manner: 0.0 V/0.0 A; 0.03 V/5 A; 0.05 V/10 A; 0.08 V/15 A; 0.10 V/20 A; 0.13 V/25 A; 0.16 V/30 A; 0.18 V/35 A; 0.22 V/40 A. After 4 hours, the voltage/current ratio had settled down at 0.18 V/40 A. The amalgam circuit was then charged with 39 kg of amalgam. The contents of the amalgam circuit were heated to 330° C. with the pump switched off and the circuit was then put into operation. During operation, the sodium present in the anode chamber was flushed out and dispersed in the amalgam itself.

This first charge was discarded and the circuit was filled with fresh amalgam which contained 0.4% by weight of sodium and had been heated to 330° C. A mean flow velocity of 0.3 m/s, corresponding to a circulation volume flow of 0.29 $m^3$/h, was set.

In the currentless state, a cell voltage of 0.82 V was established. The output voltage of a DC grid apparatus was limited to 2 volt and the current circuit was closed with the cell. Over a period of 3 hours, the current was increased linearly from 0 to 40 A. 7.8 kg of amalgam were then drained from the circuit every 30 minutes and replaced by fresh amalgam. During this procedure, it was observed that the cell voltage fluctuated between 1.1 volt after filling and 1.12 volt prior to drainage. A current of 40 A at the anode area of 200 $cm^2$ corresponds to a current density of 2000 A/$m^2$. This is twice as high as that required for industrial utilization of the process. Sodium was discharged continuously. The amount of sodium discharged and the depletion of the amalgam corresponded to Faraday's Law. The analytical results of Example 1 were confirmed.

Comparative Example 2

Apparatus, FIG. 1

The cell shown in FIG. 1 was similar to that described in GB 1,155,927 and comprised, in its interior, a tube (1) of potassium beta"-aluminum oxide (32 mm external diameter, 100 mm length) which was closed at one end and had a wall thickness of 1.2 mm. At the open end, a ring of alpha-aluminum oxide (2) was fitted in a helium-tight manner by means of a glass solder connection. By means of this ring, the potassium beta"-aluminum oxide tube which conducts potassium ions was installed with the opening facing upward in a cylindrical stainless steel container (3) (having an internal diameter of about 80 mm and a length of about 150 mm and made of austenitic stainless steel 1.4571) and sealed. For this purpose, the alpha-aluminum oxide ring (2) was clamped with a flat seal below (4) and above (5) between the housing flange (6) and the cover flange (7) by means of three clamping bolts (8).

An anode power lead (9) was attached to the stainless steel container. For the introduction of amalgam, a pipe section (10) was welded on laterally at the top and a pipe section (11) was welded on laterally at the bottom to provide the outlet for the amalgam. A stainless steel tube (13) as cathodic power lead projected from the cover flange into the opening of the potassium beta"-aluminum oxide tube. The same tube (13) was passed through the cover flange and was provided laterally at the top with a drilled hole for the outflow of liquid potassium. The apparatus was wound with electric heating tapes (14) and was thermally insulated (15).

The anode was the amalgam charge (16) between the housing and the outer wall of the solid electrolyte tube which conducts potassium ions. The cathode (17) was the liquid potassium charge within the solid electrolyte tube which conducts potassium ions. The liquid potassium formed was discharged under the reaction pressure via the heated outlet pipe into an argon (21)-blanketed vessel (20) which was partly filled with paraffin oil (22), and solidified in paraffin oil (22) , in the form of small spheres (23). Owing to the low density (0.86 g/$cm^3$) of potassium, the potassium spheres floated just under the surface of the paraffin oil.

Experimental Procedure

The installation of the potassium beta"-aluminum oxide tube was carried out promptly within one hour in an argon atmosphere after it had been taken from a vacuum pack. During installation, 50 g of potassium metal were placed in the ceramic tube. Both chambers of the cell were then flooded with argon and the cell was closed. The anode space was filled with 8 kg of 0.4% strength by weight potassium amalgam. The filled cell was then heated to 250° C. at a heating rate of 20° C./h. In the currentless state, a cell voltage of 1.01 V was established. The output voltage of a DC grid apparatus was limited to 2.1 volt and the current circuit was closed with the cell. During operation of the experiment for 165 minutes, a current of from 0.4 A to 0.7 A was observed. A current of 0.7 A at the anode area of 100 $cm^2$ corresponds to a current density of 70 A/$m^2$ which is insufficient for industrial utilization of the process. During the time of the experiment, no potassium was discharged because the amount formed was not sufficient to completely fill the ceramic tube and the discharge lines. Within the limits of measurement accuracy, no decrease in the potassium concentration in the amalgam could be detected.

EXAMPLE 4

Apparatus

The experimental apparatus described in Comparative Example 2 was supplemented by a stirrer (18) (length 42 mm, diameter 5 mm) installed at the bottom of the vessel (FIG. 2). The stirrer was driven by a customary laboratory magnetic stirrer. The same device as in Example 1 prevented the stirrer from floating in the very dense amalgam (density= 13,600 kg/$m^3$). The stirrer speed was a maximum of 100 $min^{-1}$.

Experiment

The experimental procedure was as in Comparative Example 2, but with stirring of the anode. In addition, the polarity was initially reversed during start-up, so that the outer chamber containing the amalgam was operated as cathode and the inner chamber of the ceramic containing liquid potassium was operated as anode. Over a period of 27 minutes, the current was increased once from 1 A to 10 A in steps of 1 A each. The experiment was then carried out as described in Comparative Example 2. During a running time of 90 minutes, an average current of 10 A was set (initially 12 A, at the end of the reaction 9 A). The cell voltage was limited to a maximum of 2.1 V. After disconnection of the power supply, a cell voltage of 1.08 V was measured in the currentless state. A current of 10 A and the anode area of 100 $cm^2$ corresponds to a current density of 1000 A/$m^2$ which allows industrial utilization of the process. During the time of the experiment, liquid potassium was discharged and dripped into an argon-blanketed glass container filled with paraffin oil. The potassium which solidified as spheres was dissolved in ethanol and analyzed for other metals (Al, Bi, Ca, Cd, Co, Cr, Cu, Fe, Li, Mg, Mn, Mo, Na, Ni, Pb, Sb, Sn, Ti, V, Zn, Zr, Hg, K) by atomic absorption spectrometry at a detection limit of 1 ppm, with the exception of Hg 0.1 ppm. Only the following metallic impurities were found: 0.2 ppm of Hg, 0.023% of Na.

The depleted amalgam was drained from the hot (250° C.) cell into a cooled receiver. A decrease in the potassium concentration in the amalgam from 0.40% by weight to 0.11% by weight was found by titration.

EXAMPLE 5

Apparatus

The apparatus employed in the experiment corresponded to that in Example 4.

Experiment

The experiment was carried out in 6 single batches as a follow-up experiment to Example 4.

For each batch, the anode chamber which had been heated to 250° C. was refilled with 8 kg of 0.4% strength by weight amalgam preheated to about 200° C. In the currentless state, a cell voltage of 1.01 V was always established at the beginning of the reaction. The output voltage of a DC grid apparatus was always limited to 2.2 volt and the current circuit was closed with the cell.

The control value for the current was set to 10 A. Over a running time of 90 minutes, a constant current of 10 A at a cell voltage of from 2.0 V to 2.1 V was observed right through to the end of the reaction. This is excellent for industrial utilization of the process. An average of 21.7 g of potassium were discharged per batch. Within the limits of measurement accuracy, this corresponds to Faraday's Law. The analytical results of Example 4 were confirmed. A decrease in the potassium concentration in the amalgam from 0.40 to 0.12% by weight was found by titration.

EXAMPLE 6

Apparatus FIG. 3

The cell shown in FIG. 3 comprised, in its interior, a tube (31) of potassium beta"-aluminum oxide which was closed at one end (32 mm external diameter, 100 mm length, wall thickness 1.2 mm). A ring of alpha-aluminum oxide (32) was fitted in a helium-tight manner at the open end by means of a glass solder connection. By means of this ring (32), the beta"-aluminum oxide tube which conducts potassium ions was installed with the opening downward in a concentric stainless steel tube (33) (having an internal diameter of 37 mm and a length of about 105 mm). A critical aspect was that the internal diameter of the steel tube was matched to the external diameter of the ceramic tube so as to form an annular gap having a width of 2.5 mm. The anode chamber defined by the annular gap and the tube length met, firstly, the need for an engineering concept which makes do with a relatively small quantity of mercury in the apparatus. Secondly, the cross section of the annulus allowed an axial flow through the anode chamber which was very effective in respect of the current density. To seal the apparatus, the alpha-aluminum oxide ring (32) was clamped with a flat seal below (36) and above (34) between the housing flange (36) and the cover flange (37) by means of three or four clamping bolts (38).

An anode power lead (39) was attached to the stainless steel container. For the introduction of amalgam, a pipe section (40) was welded on laterally at the bottom and a pipe section (41) was welded on laterally at the top to provide the outlet for the amalgam. A stainless steel tube (43) as cathodic power lead projected from the cover flange into the opening of the potassium beta"-aluminum oxide tube. The same tube (43) was passed through the cover flange and served for the free discharge of liquid potassium. The cell could be wound with electric heating tapes (44) and insulated or installed together with a plurality of tubes in a heated chamber.

The anode was the amalgam charge in the annular space between the inner wall of the steel tube and the outer wall of the solid electrolyte tube which conducted potassium ions. The cathode was the liquid potassium charge within the solid electrolyte tube which conducted potassium ions. The liquid potassium formed was discharged under the reaction pressure via the heated outlet pipe (43) into a container which was blanketed with inert gas and partly filled with paraffin oil and solidified in the paraffin oil in the form of small spheres.

The electrolysis cell was integrated into an apparatus designed for continuous operation and having the following functions FIG. 4:

- Continuous supply (51) with dry, preheated, K-rich amalgam.
- Heating (52) designed for heating in the range from 265° C. to 400° C.
- DC supply (53).
- Defined flow velocity in the anode by means of an internal amalgam circuit (54) driven by a pump (55), able to be adjusted steplessly in the range from 0.02 m/s to 0.8 m/s.
- Offtake of liquid potassium (56).
- Continuous discharge of K-depleted amalgam (57).
- Waste gas treatment (58).
- Safety monitoring, particularly in respect of Hg emission (59).

Experiment

The commercial potassium beta"-aluminum oxide tube was installed promptly within one hour in an argon atmosphere after it had been taken from a vacuum pack. Both chambers of the cell were then flooded with argon and the cell was closed. Installation into the apparatus was carried out 2–5 days later. The apparatus was heated to 270° C. at 20° C./h. The cathode chamber within the ceramic tube closed at one end was then filled via a feed line with externally melted potassium and the anode chamber outside the ceramic tube was likewise filled with liquid potassium. Over a period of 40 minutes, the current was increased once from 4 A to 20 A in steps of 4 A and was then held at 20 A for 4 hours. The cell voltage followed the current steps in the following manner: 0.0 V/0.0 A; 0.40 V/4 A; 0.81 V/8 A; 1.23 V/12 A; 1.62 V/16 A; 2.03 V/20 A. After 4 hours, the voltage/current ratio had settled down at 1.99 V/20 A. The amalgam circuit was then charged with 26 kg of amalgam. The contents of the amalgam circuit were heated to 270° C. with the pump switched off and the circuit was then put into operation. During operation, the potassium present in the anode chamber was flushed out and dispersed as a solution in the amalgam.

This first charge was discarded and the circuit was filled with fresh amalgam which contained 0.4% by weight of potassium and had been heated to 270° C. A mean flow velocity of 0.4 m/s, corresponding to a circulation volume flow of 0.39 $m^3/h$, was set. In the currentless state, a cell voltage of 1.01 V was established. The output voltage of a DC grid apparatus was limited to 2.2 volt and the current circuit was closed with the cell. Over a period of 3 hours, the current was increased linearly from 0 to 10 A. 8.5 kg of amalgam were then drained from the circuit every 60 minutes and replaced by fresh amalgam. During this procedure, it was observed that the cell voltage fluctuated between 2.0 volt after filling and 2.12 volt prior to drainage. A current of 10 A at the anode area of 100 $cm^2$ corresponds to a current density of 1000 $A/m^2$. This is more than sufficient for industrial utilization of the process.

Potassium was discharged continuously. The amount of potassium discharged and the depletion of the amalgam corresponded to Faraday's Law. The analytical results of Example 5 were confirmed.

What is claimed is:

1. A process for producing an alkali metal from alkali metal amalgam by electrolysis utilizing an anode containing alkali metal amalgam, a solid electrolyte conducting alkali metal ions and a liquid alkali metal as cathode, wherein the alkali metal amalgam as anode is kept in motion under atmospheric pressure or slightly superatmospheric pressure by stirring and/or by means of a pump driven in an internal circuit thereby producing an alkali metal.

2. A process as claimed in claim 1, wherein the alkali metal is sodium and the process is carried out at from 310 to 400° C.

3. A process as claimed in claim 1, wherein the alkali metal is potassium and the process is carried out at from 260 to 400° C.

4. A process as claimed in claim 1, carried out at current densities above 250 $A/m^2$.

5. A process as claimed in claim 1, wherein the alkali metal amalgam comes from chloralkali electrolysis.

6. A process as claimed in claim 1, wherein the solid electrolyte is selected from the group consisting of sodium β"-aluminum oxide, sodium β-aluminum oxide and sodium β/β"-aluminum oxide or potassium β"-aluminum oxide, potassium β-aluminum oxide and potassium β/β"-aluminum oxide.

* * * * *